US008267619B2

(12) United States Patent
Munz

(10) Patent No.: US 8,267,619 B2
(45) Date of Patent: Sep. 18, 2012

(54) ROAD PAVER

(75) Inventor: Roman Munz, Neustadt (DE)

(73) Assignee: Joseph Voegele AG, Ludwigshafen (DE)

( * ) Notice: Subject to any disclaimer, the term of this patent is extended or adjusted under 35 U.S.C. 154(b) by 360 days.

(21) Appl. No.: 12/556,519

(22) Filed: Sep. 9, 2009

(65) Prior Publication Data

US 2010/0080655 A1 Apr. 1, 2010

(30) Foreign Application Priority Data

Sep. 26, 2008 (EP) ..... 08016989

(51) Int. Cl.
*E01C 19/22* (2006.01)

(52) U.S. Cl. ..... 404/118; 404/101

(58) Field of Classification Search ..... 404/83, 404/96, 101, 104, 105, 106, 114, 118, 119
See application file for complete search history.

(56) References Cited

U.S. PATENT DOCUMENTS

| | | | | | |
|---|---|---|---|---|---|
| 3,155,021 | A * | 11/1964 | Gebhardt, Jr. et al. | 404/118 |
| 3,221,618 | A * | 12/1965 | Hudis | 404/101 |
| 3,262,378 | A * | 7/1966 | Schrimper et al. | 404/120 |
| 3,354,801 | A * | 11/1967 | Hanson | 404/105 |
| 3,838,933 | A * | 10/1974 | Lehman et al. | 404/114 |
| 3,841,777 | A * | 10/1974 | Domenighetti | 404/84.1 |
| 3,907,451 | A * | 9/1975 | Fisher et al. | 404/101 |
| 4,073,592 | A * | 2/1978 | Godberson et al. | 404/82 |
| 4,289,421 | A * | 9/1981 | Sampey et al. | 404/106 |
| 4,379,653 | A * | 4/1983 | Brown | 404/118 |
| 4,778,305 | A * | 10/1988 | Ritchey et al. | 404/105 |
| 5,232,305 | A * | 8/1993 | Bassett et al. | 404/101 |
| 5,348,418 | A * | 9/1994 | Campbell | 404/103 |
| 6,059,489 | A * | 5/2000 | Heims | 404/96 |
| 6,309,138 | B1 * | 10/2001 | Yasu et al. | 404/101 |
| 6,582,152 | B2 * | 6/2003 | Leone et al. | 404/75 |
| 6,595,719 | B1 | 7/2003 | Ohseki et al. | |
| 6,890,125 | B1 * | 5/2005 | Calder et al. | 404/104 |
| 7,044,681 | B2 * | 5/2006 | Quenzi et al. | 404/84.1 |
| 7,108,450 | B2 * | 9/2006 | Grubba | 404/84.5 |
| 7,651,295 | B2 * | 1/2010 | Eppes et al. | 404/84.05 |
| 2006/0120801 | A1 * | 6/2006 | Johnson | 404/118 |
| 2007/0116520 | A1 * | 5/2007 | Quenzi et al. | 404/114 |

FOREIGN PATENT DOCUMENTS

| | | |
|---|---|---|
| DE | 29713808 | 11/1997 |
| DE | 10028819 A1 | 1/2001 |
| DE | 10200361 A1 | 7/2003 |
| EP | 1120495 A1 | 8/2001 |

* cited by examiner

*Primary Examiner* — Robert Pezzuto
*Assistant Examiner* — Matthew D Troutman
(74) *Attorney, Agent, or Firm* — Fish & Richardson P.C.

(57) ABSTRACT

A road paver F has a paving screed E the working width of which can be adjusted continuously. In order to further enlarge the working width in steps at least one paving screed extension can be mounted. A distributing auger is supported in a distributing auger support. Distributing auger extensions can be mounted to the distributing auger. Scraper blades are arranged in casting travelling direction behind distributing auger. At least a scraper blade section functionally associated to a mounted paving screed extension is carried by a channel sheet steel plate being part of the mounted distributing auger extension. The scraper blade section can be adjusted in height direction together with the distributing auger support via a drive which can be remotely controlled during a casting process.

12 Claims, 3 Drawing Sheets

ROAD PAVER

FIELD OF THE INVENTION

The invention relates to a road paver that includes a towing vehicle having a chassis, and a paving screed linked to the chassis and having at least one extension screed part which is retractable or extendible for continuously varying the working width of the paving screed.

BACKGROUND OF THE INVENTION

In practice it is known for road pavers to first roughly pre-adjust the height of the paving material heap in front of the distributing auger. The distribution of the paving material made by the distributing auger for the respective thickness of the cast layer which is varied by the paving screed is then also adjusted correctly during the casting process by adjusting the distributing auger together with the auger support in height direction at the rear side of the chassis of the towing vehicle. In the case of large working widths the distributing auger is extended by mounting distributing auger extensions. The extension screed parts of the paving screed are further extended accordingly by mounting extension parts. The distributing auger extensions are arranged together with channel sheet metal plates and supports in casting travelling direction ahead of the paving screed. The extension screed parts are arranged at guiding systems at the rear side of the base screed of the paving screed. The poured paving material has to be spread outwardly in front of the paving screed. During the casting process the poured paving material is dragged by the paving screed in casting travelling direction. Due to the arrangement of the extension screed parts at the rear side of the base screed, in this case, paving material heaps of different volumes exist. During the casting process and owing to high dragging resistance of the poured paving material very high forces are introduced into the guiding system of the extension screed parts, which forces cause paving screed distortions which frequently deteriorate the evenness of the produced road mat. The forces also finally have an undesirable limiting influence on the maximum working width of the paving screed. In order to reduce the height of the paving material poured in front of the extension screed parts and also in front of mounted paving screed extensions and in order to reduce the dragging resistance occurring there scraper blades are mounted in front of and at the paving screed extensions. The height position of the scraper blades can be adjusted in relation to the respective paving screed extensions in order to minimise the height or to correctly adjust the height of the poured paving material in front of the extension screed part and the paving screed extension, respectively.

Furthermore, road pavers are used in practice at which scraper blade sections are instead mounted at distributing auger extensions of the distributing auger. The distributing auger is fixed at the chassis at a height position which cannot be changed during a casting process. Holders for the scraper blade sections comprise different hole arrangements with oblong holes allowing to adjust the height position of the scraper blade sections relative to the distributing auger extensions only during a break of a casting process in order to optimally limit the height of the poured paving material for the paving screed, which paving material is then cast into the road mat by the extended extension screed part or a paving screed extension. However, the distribution and height of the paving material cannot be adjusted during a casting process corresponding to the respective thickness of the road mat.

Further prior art can be found in: DE 102 00 361 A1, DE 100 28 819 A1, DE 297 13 808 U1, EP 1 120 495 A.

BRIEF SUMMARY OF THE INVENTION

It is an object of the invention to provide a road paver allowing to properly cast road mats with extremely large working widths, and to carry out a common adjustment of the height positions of the distributing auger and the scraper blades during a casting process, and to achieve a dragging force relief of the paving screed guiding systems.

This object is achieved by a road paver that comprises that comprises a towing vehicle having a chassis, and being a paving screed having at least one extension screed part which is retractable or extendible for continuously varying the working width of the paving screed linked to the chassis. At least one paving screed extension can be mounted at the extension screed part for further enlarging the working width in steps.

The paver includes a distributing auger carried at a rear end of the towing vehicle chassis by at least one distributing auger support, the height position of the distributing auger being continuously adjustably remotely controlled during a road mat casting process by a drive.

Upright channel steel sheet plates are mounted together with at least one distributing auger extension, the channel sheet steel plates being positioned in casting travelling direction (R) in front of the distributing auger for adaptation of the working width in steps. Upright scraper blades are located between the distributing auger and the paving screed. These upright scraper blades are combined from sections for adaptation to the working width in steps, the scraper blades being functionally associated at least to the extended extension screed part and to each mounted paving screed extension.

As the scraper blades which act at least in the regions of the paving screed extensions are supported at the channel sheet steel plates, the paving screed is relieved of forces resulting from the dragging resistance of the paving material. This makes it possible to cast a road mat with an even larger working width with the same stiffness of the paving screed and without deteriorating the evenness of the surface of the cast road mat. The height of the poured paving material as limited by the scraper blade in front of the extension screed part and in front of a paving screed extension as well as the height of the paving material heap in the region of the distributing auger can be varied during a casting process solely by varying the height position of the distributing auger support at the chassis. This also adjusts the height positions of the channel sheet steel plates and the scraper blades, in order to adapt the distribution of the poured paving material to the respective thickness of the cast road mat.

An additional fine tuning of the height position of the scraper blades may be carried out during the casting process, e.g. by means of spindles. This concept also eliminates forces on the paving screed resulting from the start-up and/or a sudden change of the speed of the distributing auger because any occurring forces are kept away from the paving screed and are directly introduced into the chassis.

In an expedient embodiment and for larger working widths the respectively vertically arranged channel sheet steel plates are arranged in casting travelling direction in front of the extended distributing auger, in particular between the end of the distributing auger support and the end of the distributing auger. The channel sheet steel plates carry scraper blades which are also functionally associated to the extended extension screed parts and the paving screed extensions. The height positions of the channel sheet steel plates and the scraper blades can be adjusted commonly by the provided drive and via the distributing auger support at the chassis.

Particularly expediently a scraper blade or a scraper blade section carried by the channel sheet steel plates has additionally at least one height position fine adjustment assembly which can be actuated manually or by a drive. The height position fine adjustment assembly permits adjustment of the scraper blade height position relative to the distributing auger and independently from an actuation of the drive used for height adjustments of the distributing auger support. The minimum height limit of the poured paving material can be adjusted at least in front of the paving screed extension independent from the height limit of the poured paving material in front of the central region of the paving screed.

In an expedient embodiment the paving screed comprises a crown profile adjustment device. In order to allow to permit adjustments of the scraper blade or the scraper blade section carried by the channel sheet steel plate relative to the distributing auger extension and at least substantially corresponding to an adjusted crown profile, the scraper blade or the scraper blade section is adjustable corresponding to the crown profile in the paving screed, preferably by means of the height position fine adjustment assembly, and in order to also adjust an optimum varying height limit of the poured paving material for the crown profile of the surface of the cast road mat.

In another embodiment the at least one scraper blade section functionally associated with the extended extension screed part as well as the corresponding channel sheet steel plate section are both commonly suspended at the distributing auger support, even in the case that no distributing auger extension is provided. No material distributing forces are transferred from the scraper blade section to into the paving screed or the extension screed part in this region.

In a further embodiment the scraper blade section functionally associated to the extended extension screed part, the corresponding section of the channel sheet steel plate and a provided distributing auger extension are all commonly suspended at the distributing auger support, in order not to transfer in this region any distributing forces to the paving screed or the extension screed part.

Specifically for very large working widths it is expedient that the channel sheet steel plate, and via the channel sheet steel plate the scraper blade as well are additionally supported via at least one longitudinal beam at one chassis side or an undercarriage carrier side. The longitudinal beam also stabilises a provided distribution auger extension against dragging forces.

The channel sheet steel plate and the scraper blade, optionally also a provided distributing auger extension, alternatively or additively may be stably supported at the distributing auger support via at least one oblique lateral strut.

A structurally simple and comfortably manipulatable height position fine adjustment assembly of the scraper blade comprises at least one screw spindle gear mechanism. The screw spindle gear mechanism operates with a self-locking feature and thus hinders uncontrolled adjustments of the scraper blade. Furthermore, the screw spindle gear mechanism allows to carry out height position fine tunings very sensitively.

In an expedient embodiment a channel sheet steel plate equipped with a bearing pillar for a bearing of the distributing auger extension is fixed to the distributing auger support. Each eventually needed further section of the channel sheet steel plate is then fixed to the preceding one. The scraper blade functionally associated to a respective channel sheet steel plate and having its height position fine adjustment assembly is connected via a scraper blade carrier by means of a connection part, preferably a carrier console, with the channel sheet steel plate. Each structural group consisting of a channel sheet steel plate, a bearing pillar, a distributing auger extension, a scraper blade, and the connection part is an equipment component of the road paver which can be mounted and removed rapidly.

In a further embodiment a complete unit consisting of a channel sheet steel plate, a bearing pillar, a distributing auger extension, a connecting part, and a scraper blade is connected by means of a carrier console provided at the bearing pillar via a lateral strut with the distributing auger support. This concept allows to achieve a very stable supporting structure for the different components which are interconnected with each other and which do not load the paving screed with dragging forces or weight forces.

A mounting structure group for adapting the road paver to a large working width comprises expediently at least one connection part with a channel sheet steel plate carrier, optionally even connection points for longitudinal beams, at least one carrier console comprising at least one bearing pillar for the distributing auger shaft as well as optionally a coupling location for a lateral strut, at least one connection part, and a distributing auger extension, e.g. an auger shaft extension which is either equipped with auger wings or can be equipped with auger wings. The respective section of the channel sheet steel plate and/or the section of the scraper blade already may be pre-mounted at the mounting structure group.

BRIEF DESCRIPTION OF THE DRAWINGS

An embodiment of the invention will be explained with the help of the drawings. In the drawings is.

DETAILED DESCRIPTION OF THE INVENTION

Figure 1:
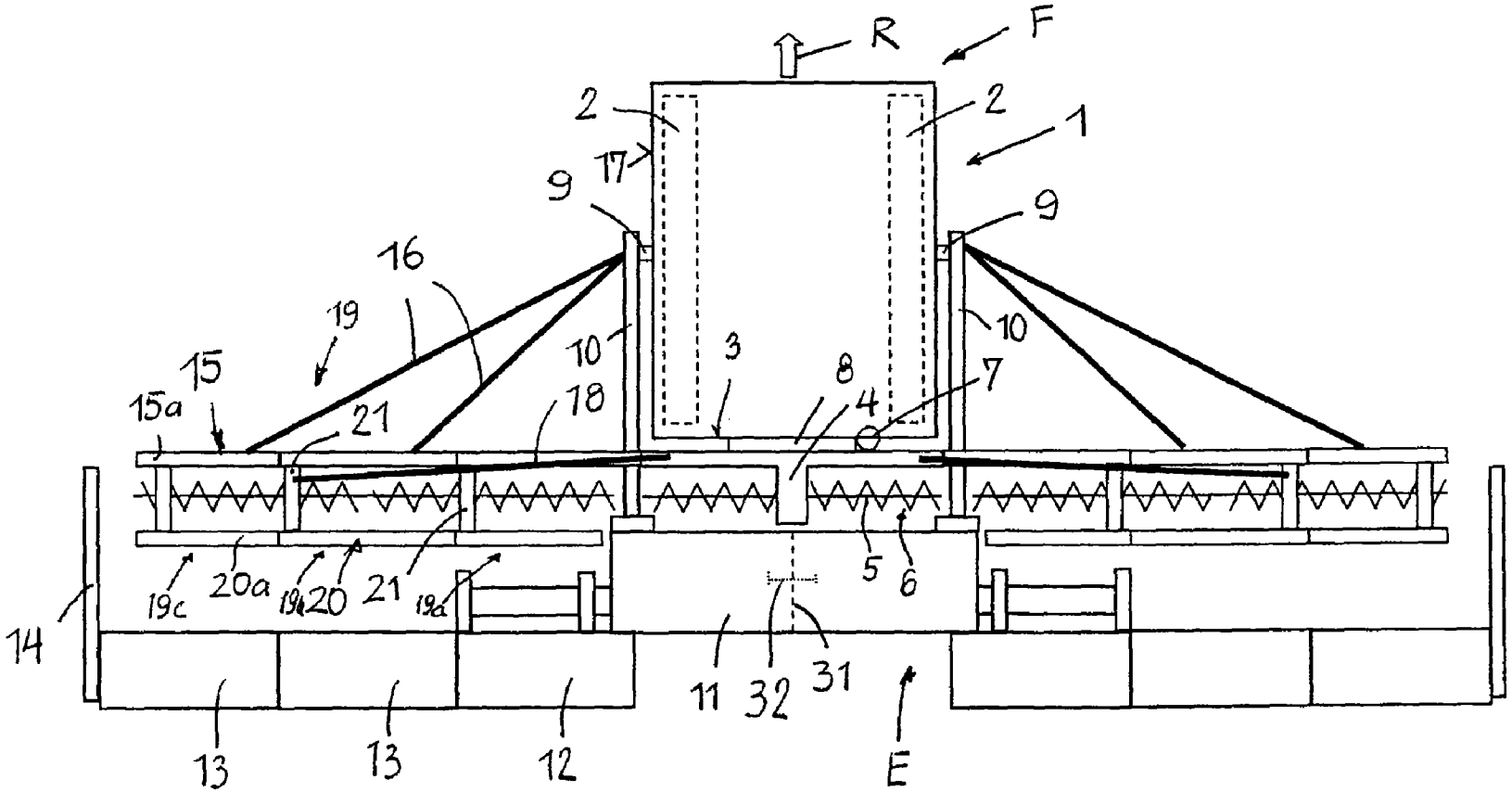
FIG. 1 a schematic top view of a road paver adapted for large working widths, FIG. 2 a side view of the road paver of FIG. 1, and FIG. 3 a schematic top view of the road paver adjusted for a smaller working width.

FIG. 1 shows in a schematic top view main components of a road paver F, in particular of a road paver F intended for operation with a large working width. A towing vehicle 1 has a chassis, not shown in detail, and an undercarriage 2. At a rear side 3 of the chassis at least one distributing auger support 4 is arranged in a vertical guidance 8 such that the distributing auger support 4 can be adjusted in its height position by means of a remotely controlled drive 7. The distributing auger support 4 has a functional connection to a rotary drive not shown in detail and carries a distributing auger 6 having an auger shaft 5, both being oriented laterally behind the towing vehicle 1. Alternatively, there may be provided two adjacent distributing auger supports 4 for two distributing auger halves, each being adjustable in height direction (not shown).

Sidewardly arranged towing bars 10 are linked to towing points 9 arranged at the towing vehicle 1 or the chassis of the towing vehicle 1. The towing bars 10 drag a paving screed E fixed to the towing bars 10 behind the towing vehicle 1. The paving screed E comprises a base screed 11 and two extension screed parts 12 arranged at the rear side of the base screed 11 at not shown guiding systems, such that the extension screed parts 12 can be extended and retracted continuously. The extension screed parts 12 allow to continuously vary the working widths of the paving screed E between a base width defined by the width of the base screed 11 and a larger working width defined by the fully extended extension screed part 12 plus the base screed 11. In order to further enlarge the working width in steps, sequentially extension screed extensions 13 may be flanged to the ends of both extension screed parts 12. End plates 14 are mounted at the outer sides of the paving screed E, irrespective of whether a casting process is carried out only by using the extension screed parts 12 or even when using paving screed extensions 13.

Substantially upright channel sheet steel plates 15 are provided in casting travelling direction R ahead of the distributing auger 6. The channel sheet steel plates 15 hinder that (FIG. 2) paving material 27 poured on the planum in the region in front of the distributing auger 6 flows away in casting travelling direction R. The channel sheet steel plates 15 e.g. are combined from channel sheet steel plate sections 15*a*, respectively corresponding with the intended working width. The channel sheet steel plate 15 may additively be supported by longitudinal beams 16 which extend obliquely inwards at the outer sides 17 of the chassis or the undercarriage.

The longitudinal extension of the distributing auger 6 can be adapted to the respective intended working width by selectively mounting distributing auger extension 19*a*, 19*b*, 19*c* at the outer ends of the distributing auger 6. A section 5*a* of the auger shaft 5 can be suspended in at least one bearing pillar 35, shown in FIG. 2. A substantially upright scraper blade 20, e.g. combined from scraper blade sections 20*a*, is arranged in casting travelling direction R behind the distributing auger 6 and in front of the extension screed parts 12 and each provided paving screed extension 13. At least those sections 20*a* of the scraper blade 20 which functionally are associated to the paving screed extensions 13 are carried by the channel sheet steel plate 15 but do not have a structural connection with the paving screed extensions 13.

Each distributing auger extension 19*a*, 19*b*, 19*c* may define a mounting structural group (FIG. 1, 2), and can be mounted selectively. The mounting structural group may comprise an inverted U-shaped connection 21, which, when mounted, extends substantially parallel to the casting travelling direction R, a carrier console 34, at least one bearing pillar 35 carried by the carrier console 34, and carriers 33, 26 for channel sheet steel plates 15 and scraper blades 20. Optionally, even at least one section 15*a* of a channel sheet steel plate 15 and at least one scraper blade section 20*a* may be premounted in the mounting structure group. The scraper blade section 20*a* optionally may be equipped with a height position fine adjustment assembly H. A shaft section 5*a* of the auger shaft 5 may be suspended in the bearing pillar 35. The shaft section 5*a* of the distributing auger 6 may be equipped or can be equipped with auger wings 6*a*. Coupling locations for lateral struts 18 may be provided at the connecting part 21 or at the carrier console 34. At least one channel sheet steel plate carrier 33 may comprise at least one coupling location for a longitudinal beam 16.

The paving screed E may be equipped with a crown profile adjustment device 31, 32, i.e., the base screed 11 then is subdivided in the middle into two base screed parts which can be pivoted in relation to each other about a longitudinal axis 31 situated in a low position. The base screed parts may be pivoted by an actuation device 32 e.g. a screw spindle device or screw spindle gear mechanism from a relative stretched position downwardly. In the case that an angled crown profile is adjusted, between the base screed part this crown profile also is formed in the surface of a road mat by the extension screed parts 12 and paving screed extensions 13. Also the scraper blade 20 or the sections 20*a* of the scraper blade may be adjusted or tilted relative to the distributing auger 6, e.g. by means of the respective height position fine adjustment assembly H corresponding to an adjusted crown profile. The scraper blade sections 20*a* are respectively carried by at least one connection part 21 and are supported by the connection part 21 against tilting.

Figure 2:
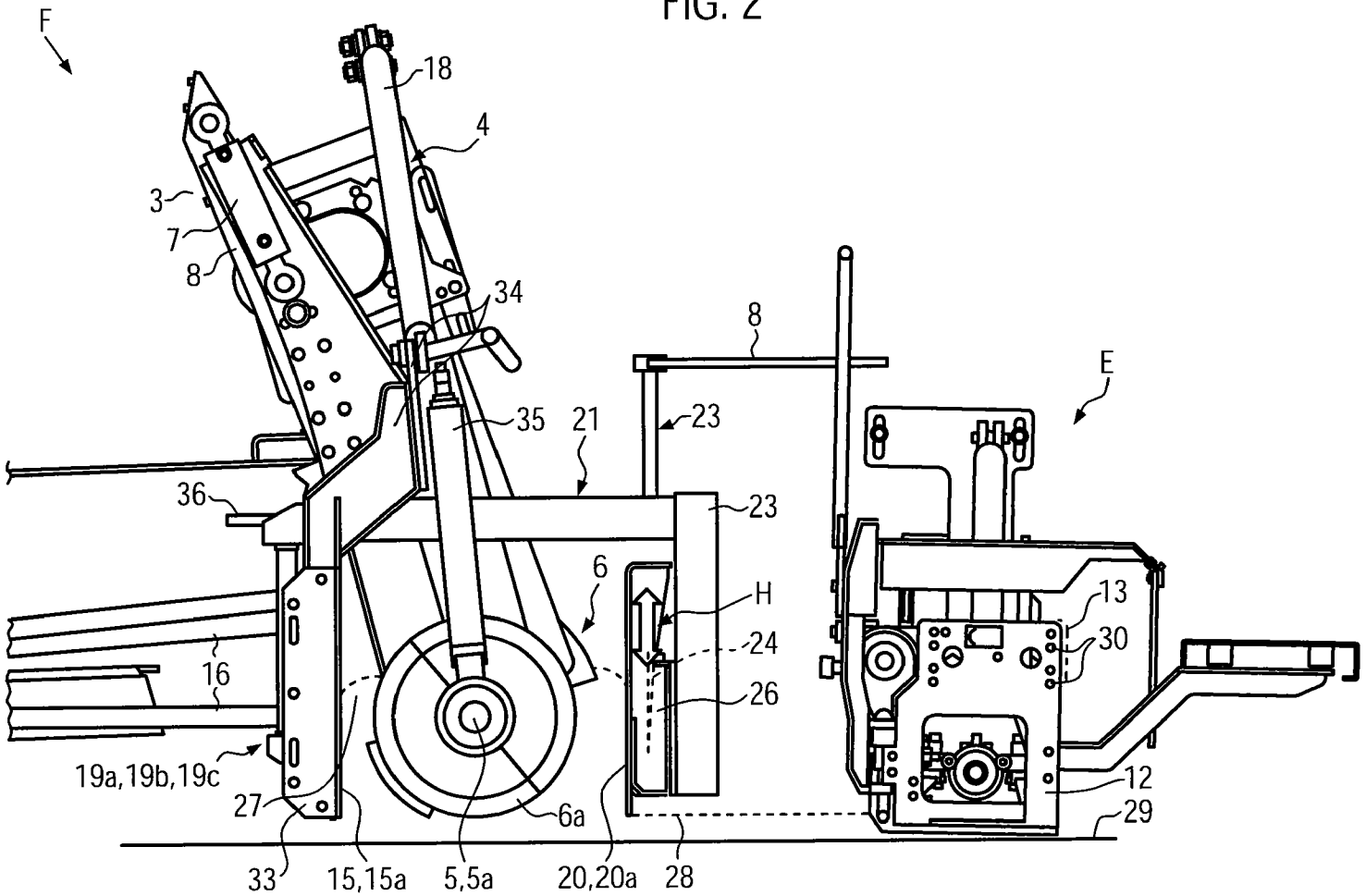

FIG. 2 shows that the distributing auger support 4 can be adjusted in height direction by the at least one drive 7 (e.g. a hydraulic cylinder) in the vertical guidance 8 at the rear end 3 of the chassis. The drive 7 can be remotely controlled during a casting process, e.g. from the operator's platform of the road paver F, or even from a suitable external operating platform at the paving screed E.

The extension screed part 12 of the paving screed E (the base screed 11 is not shown in FIG. 2) has at an end side fixation locations 30 either for mounting the end plate 14 or a first paving screed extension 13. The extension screed part 12 and/or mounted paving screed extensions 13 cast a road mat 20 from poured paving material with a predetermined thickness. The heap of poured paving material 27 is relatively high between the channel sheet steel plate 15 and the scraper blade 20, however, the height of the heap then is limited by the scraper blade 20 to an optimum lower level 28 for the paving screed E.

The shaft section 5*a* of the auger shaft 5 of a mounted distributing auger extension 19*a*, 19*b*, 19*c* is supported in the at least one bearing pillar 35 which is connected to the carrier console 34 or the connecting part 21, which connection part 21 e.g. is secured at the channel sheet steel plate carrier 33. The carrier console 34 or each or at least one of the connecting parts 21 additionally may be supported via an oblique lateral strut 18 at the distributing auger support 4.

The channel sheet steel plate carrier 33 is supported at the carrier console 34 via an inserted bolt 36 at a pair of longitudinal beams 16 which are arranged above each other in a triangular arrangement and extend to the chassis or to the undercarriage. The sections 15*a* of the channel sheet steel plate 15 are secured at the channel sheet steel plate carriers 33. The scraper blade carrier 26 is arranged at the carrier console 23. The scraper blade carrier 26 either has the shape of a block or extends with a limited dimension in lateral direction. The scraper blade 20 is arranged at the scraper blade carrier 26. The height position fine adjustment assembly H, e.g. a screw spindle gear mechanism 24 which can be actuated either manually or remotely controlled by a drive, is arranged between the carrier console 23 and the scraper blade carrier 26 or the scraper blade 20 or the section 20*a* of the scraper blade and the scraper blade carrier 26. For a manual actuation e.g. a ratchet lever 25 may be provided. By means of the height position fine adjustment assembly H, the scraper blade 20 or a respective scraper blade section 20*a* in this case also may be adjusted or tilted relative to the distributing auger 6 corresponding to an adjusted crown profile of the paving screed E. Alternatively, it is possible to bring the scraper blade 20 or the scraper blade sections 20*a* into inclined positions at the scraper blade carriers 26 by means of oblong hole connections or the like.

The height position fine adjustment assembly H also can be actuated during a casting process. Also the distributing auger support 4 can be continuously adjusted in height direction together with the distributing auger 6 during a casting process. The longitudinal beams 16 may be connected e.g. to the chassis or to a carrier of the undercarriage by means of universal joints or other joint arrangements such that they can follow height adjustment movements of the distributing auger support 4. Each lateral strut 28 connected to the support 4 follows height adjustment movements of the distributing auger support 4 anyhow. The lateral strut 18 is also indicated in FIG. 1 where it is shown to engage in the region of the connecting part 21 which is situated the most inwardly. There might be provided even further lateral struts 18 also extending to further connecting parts 21 or to distributing auger extensions 19*b*, 19*c*, respectively.

As the scraper blade 20 is carried by the channel sheet steel plate 15 or the channel sheet steel plate carrier 33 and is supported against tilting via the channel sheet steel plate carrier 33 or the inserted bolt 36 and the longitudinal beams 16, all loads resulting from the dragging resistance of the poured paving material 27 at the distributing auger extensions 19*a*, 19*b*, 19*c* and the scraper blade 20 as well as weight forces are directly or indirectly introduced into the chassis of the towing vehicle 1 and are kept away from the paving screed E, the extension screed parts 12 and mounted paving screed extensions 13. This results in a significant force relief of the paving screed E in the case of large working widths, such that the paving screed E can stand even larger working widths with the same stiffness as prior art paving screeds and nevertheless assures a satisfactory evenness of the road mat surface.

It may be expedient to also support further inwardly located sections 20*a* of the scraper blade 20 at the channel sheet steel plates 15.

In the case that the casting process is only carried out with the working width corresponding to the base screed width, the channel sheet steel plates 15, the scraper blades 20, and the distributing auger extensions 19*a* to 19*c* may be removed. The end plates 14 then may be mounted at the retracted extension parts 12.

Figure 3:
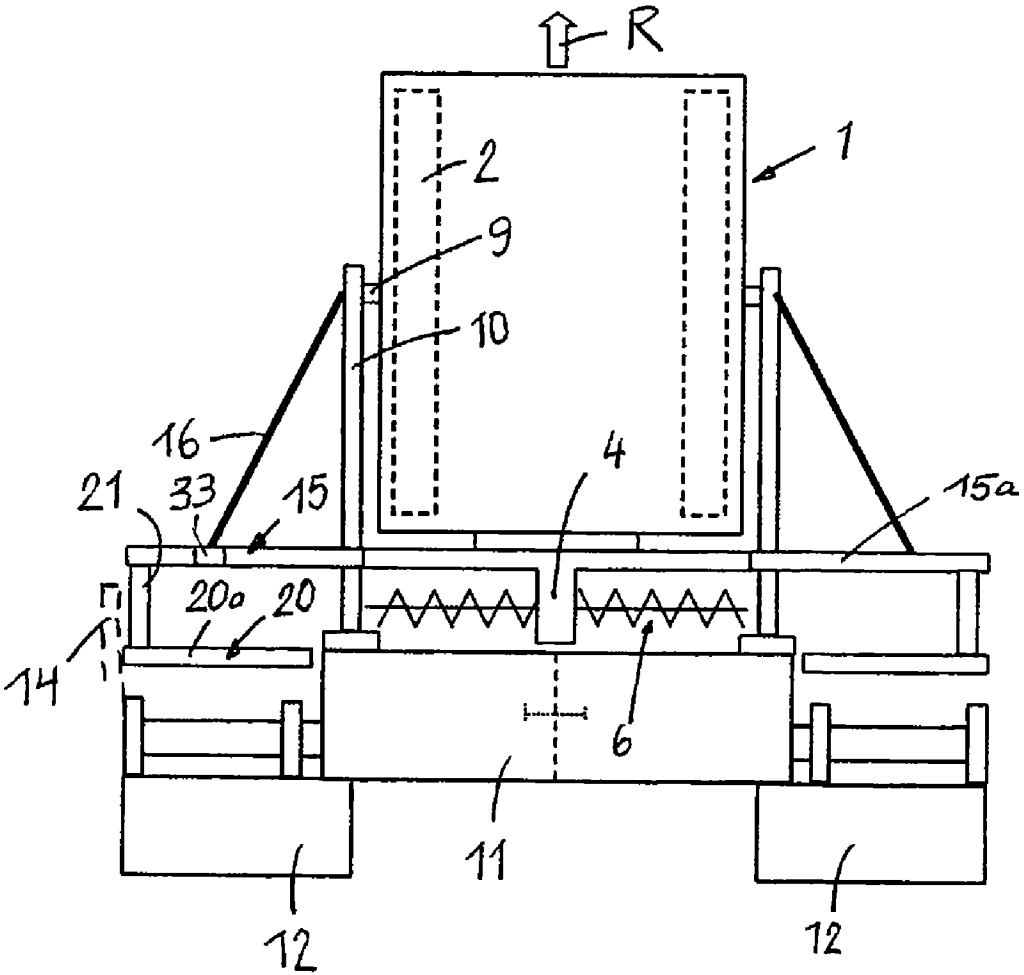

If the casting process is carried out, according to FIG. 3, only by using the base screed 11 and the extension screed parts 12 only the inner distributing auger extensions 19*a* and the inner sections 15*a*, 20*a* of the channel sheet steel plate 15 and of the scraper blade 20 will be provided. In this case unnecessary longitudinal beams 16 and/or lateral struts are removed or are dispensed with. The more the working width is enlarged in steps by mounting paving screed extensions 13, the more sections of the channel sheet steel plate 15 and of the scraper blade 20 and in some cases also distributing auger extensions 19*b*, 19*c* and longitudinal beams 16 and/or lateral struts 18 will be provided.

In order to e.g. increase the stiffness the sections 15*a*, 20*a* of the channel sheet steel plate 15 and/or the scraper blade 20 may be bluntly flanged in the respective connection location or may be flanged together even with overlaps, such that the joints become very stiff. Alternatively, a respective carrier for a channel sheet steel plate or a scraper blade may be placed where a joint has to be formed between such sections, such that each distributing auger extension 19*a*, 19*b*, 19*c* will define a structure which is stiff and rigid against distortions. Such interconnected structures will then stably support each other, even if only one lateral strut 18 or a few longitudinal beams 16 are provided.

The invention claimed is:

1. A road paver, comprising a towing vehicle including a chassis, a paving screed linked to the chassis, the paving screed having a main screed and two extension screed parts which are retractable and extendable relative to the main screed for continuously varying the working width of the paving screeds, apparatus located at the outer end of each of the extension screeds for mounting at least one paving screed extension for further enlarging the working width in steps, a distributing auger extendable by mounting distribution auger extensions and carried at a rear end of the chassis by a distributing auger support, the height position of the distributing auger being continuously adjustable by a remotely controlled drive while the road paver is travelling in a casting travelling direction, an upright channel steel sheet plate mounted to a distributing auger extension, the channel sheet steel plate being positioned in casting travelling direction in front of the distributing auger, upright scraper blades between the distributing auger and the paving screed, said scraper blades are combinable stepwise to the working width in steps, the scraper blades being functionally associated to and located in front of the extended extension screed part and each paving screed extension, and a scraper blade section located in front of a paving screed extension or an extended extension screed part and on the channel steel sheet plate, the height of the scraper blade section, the distributing auger and the channel sheet steel plate being adjustable by the drive during the road mat casting process.

2. The road paver according to claim 1, wherein the distributing auger includes distributing auger extensions mounted on the distributing auger, channel sheet steel plates having at least one bearing pillar for the distributing auger are positioned in front of the distributing auger and secured to the distributing auger support, and scraper blade sections operably connected to at least to the extended extension screed parts and a respective extension screed extension are carried by the channel sheet steel plate and are all adjustable in height by the drive.

3. The road paver according to claim 1, further comprising a height position fine adjustment assembly for adjusting the position of a scraper blade section carried by the channel steel plates relative to the distributing auger, the height position fine adjustment assembly being actuated manually or remotely controlled by a drive.

4. The road paver according to claim 1, wherein a section of a channel sheet steel plate and a second scraper blade section are both functionally connected to an extended extension screed part and secured to the distributing auger support.

5. The road paver according to claim 1, wherein the section of the channel sheet steel plate, a second scraper blade section and a distributing auger extension, are all functionally connected to an extended extension screed part, and secured to the distributing auger support.

6. The road paver according to claim 1, wherein the channel sheet steel plate and, the scraper blade are supported by at least one longitudinal beam at a side of the chassis or by a carrier of the undercarriage of the towing vehicle.

7. The road paver according to claim 2, wherein the mounted distributing auger extension is supported by at least one oblique lateral strut connected to the distributing auger support, the oblique lateral strut also supporting the scraper blade and the channel sheet steel plate.

8. The road paver according to claim 3, wherein the height position fine adjustment assembly of the scraper blade comprises at least one screw spindle gear mechanism.

9. The road paver according to claim 3, wherein the channel sheet steel plate is mounted to the distributing auger, and each further section of the channel sheet steel plate is placed further to the outside of the road paver is and mounted to the preceding inner section of the channel sheet steel plate, the distributing auger extension is supported via the at least one bearing pillar at the channel sheet steel plate, and the scraper blade and the height position fine adjustment assembly of the scraper blade are positioned on a scraper blade carrier and are connected with the respective channel sheet steel plate by a carrier console.

10. The road paver according to claim 9, wherein the channel sheet steel plate and at least one channel sheet steel plate carrier are combined joined by the connecting part with the scraper blade, the bearing pillar, a distributing auger extension and a carrier console mounted to the bearing pillar and coupled with the lateral strut, and the channel sheet steel plate carrier is supported against tilting by longitudinal beams.

11. A road paver for casting a road mat comprising a towing vehicle including a chassis, a paving screed linked to the chassis and having a main screed, an extension screed part positioned on each side of the main screed, each extension screed being retractable and extendable laterally relative to the main screed, at least one paving screed extension mounted on an outer end of each of the extension screed parts, an extendable distributing auger mounted on a distributing auger support located on a rear end of the chassis and including distribution auger extensions, a remotely controlled drive for adjusting the height of the distributing auger, an upright channel steel plate mounted on a distribution auger extension in front of the distributing auger, upright scraper blades located between the distributing auger and the paving screed and in front of the extended extension screed part and each paving screed extension, and wherein an adjustable height scraper blade section located in front of a paving screed extension or an extended extension screed part is mounted to the channel steel sheet plate, and the height of the scraper blade section, the distributing auger and the channel steel plate are adjustable during the road mat casting process.

12. The road paver of claim 1 further comprising a paving screed extension mounted at the outer end of each extension screed part.

* * * * *